US007806516B2

(12) United States Patent
Matsuno

(10) Patent No.: US 7,806,516 B2
(45) Date of Patent: Oct. 5, 2010

(54) IMAGE FORMING APPARATUS

(75) Inventor: Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 564 days.

(21) Appl. No.: 11/527,417

(22) Filed: Sep. 27, 2006

(65) Prior Publication Data

US 2007/0070171 A1 Mar. 29, 2007

(30) Foreign Application Priority Data

Sep. 27, 2005 (JP) ..... 2005-279989

(51) Int. Cl.
*B41J 2/05* (2006.01)

(52) U.S. Cl. ..... 347/65; 347/101; 347/104

(58) Field of Classification Search ..... 347/101, 347/104

See application file for complete search history.

(56) References Cited

U.S. PATENT DOCUMENTS 6,341,861 B1 * 1/2002 Sasaki ..... 347/104

FOREIGN PATENT DOCUMENTS

| | | | |
|---|---|---|---|
| JP | 7-109075 | | 4/1995 |
| JP | 2001-031309 | | 2/2001 |
| JP | 2001031309 | * | 2/2001 |

* cited by examiner

*Primary Examiner*—Stephen D Meier
*Assistant Examiner*—Alexander C Witkowski
(74) *Attorney, Agent, or Firm*—Banner & Witcoff, Ltd.

(57) ABSTRACT

An image forming apparatus includes a turning unit that turns the recording medium fed from a fixing unit, which fixes toner transferred to a recording medium and has a heating roller for heating toner, by approximately 90° with respect to a feeding direction of the recording medium, and a discharge roller that discharges the recording medium turned by the turning unit. A circumferential speed of the discharge roller is smaller than a circumferential speed of the heating roller.

12 Claims, 4 Drawing Sheets

IMAGE FORMING APPARATUS

CROSS-REFERENCE TO RELATED APPLICATION

This nonprovisional application claims priority under 35 U.S.C, §119(a) on Japanese Patent Application Laid-Open No. 2005-279989 on Sep. 27, 2005, the entire contents of which are hereby incorporated by reference.

BACKGROUND

An electrophotographic image forming apparatus forms an image on a recording medium, in such a manner that while rotating a photoreceptor drum, toner stuck on a cylindrical surface thereof is transferred to a recording medium, such as normal paper and OHP paper, and by heating the toner thus transferred to the recording medium by a heating roller, the toner is fixed to the recording medium.

However, when the recording medium is heated by the heating roller, thermal shrinkage of a surface of the recording medium on the side of the heating roller occurs. Therefore, the recording medium is easily curled along the heating roller.

In order to prevent such a curl, for example, according to the invention disclosed in Japanese Patent Application Laid-Open No. 2001-031309, the heating roller, an intermediate roller, and a curl removing roller are arranged sequentially from an upstream in a feeding direction of the recording medium, and a feeding speed by the intermediate roller is made larger than the feeding speed by the heating roller, to thereby allow a tension to act on the recording medium present between the heating roller and the intermediate roller, and allow no tension to act on the recording medium present between the intermediate roller and the curl removing roller.

BRIEF SUMMARY

Incidentally, the recording medium after fixing is discharged from a discharge port. However, since a dimension in the back and front direction (feeding direction of a recording medium) of the image forming apparatus is reduced to realize a miniaturization of the image forming apparatus, the recording medium discharged from the heating roller is discharged from the discharge port provided on the upper side, with its feeding direction turned upward by approximately 90° by a turning guide or the like.

Accordingly, in order to make the dimension in the back and front direction of the image forming apparatus smaller, the feeding direction of the recording medium horizontally discharged from the heating roller is turned at large curvature (small radius of a curve).

However, when the feeding direction of the recording medium is turned at large curvature, a bending stress generated in a curved part is increased even when a bending moment for curving the recording medium is small. Therefore, permanent distortion generates in the curved part, leading to a curl in the recording medium.

Therefore, in the image forming apparatus wherein the feeding direction of the recording medium discharged from the heating roller is made to turn at large curvature by approximately 90° to reduce the dimension of the back and front direction of the image forming apparatus, as is seen in the invention disclosed in Japanese Patent Application Laid-Open No. 2001-031309, the feeding speed by the intermediate roller is made to be larger than the feeding speed by the heating roller to allow tension to act on the recording medium present between the heating roller and the intermediate roller.

Then, bending of the recording medium occurs so as to be pressed against the turning guide by the tension acted on the recording medium, thus allowing the tension to act as the bending moment for further curving the recording medium. Therefore, further larger bending stress is generated in the curved part, resulting in generating a large curl in the recording medium.

In view of the above-described points, an aspect of the present invention is to miniaturize the image forming apparatus by turning the feeding direction of the recording medium discharged from the heating roller by approximately 90°, while suppressing a generation of curl in the recording medium.

In order to achieve the aforementioned aspect, there is provided an image forming apparatus based on electrophotography according to an aspect, comprising: a fixing unit for fixing toner transferred to a recording medium, the fixing unit having a heating roller for heating toner; a turning unit for turning said recording medium fed from said fixing unit, by approximately 90° with respect to a feeding direction of said recording medium; and a first discharge roller for discharging said recording medium, which is turned by said turning unit, to a discharge section, wherein a circumferential speed of said first discharge roller is smaller than a circumferential speed of said heating roller.

According to this structure, tension does not act on the recording medium present between the heating roller and the first discharge roller. Therefore, the recording medium is not pressed against the turning unit, and the curvature of the recording medium in the turning unit becomes smaller (bending radius becomes larger). Accordingly, a large bending stress is not generated in the recording medium, and therefore the curl can be prevented from generating in the recording medium.

The above and further objects and features will more fully be apparent from the following detailed description with accompanying drawings.

DETAILED DESCRIPTION

Preferred embodiments of a laser printer as an image forming apparatus will be explained based on the drawings hereafter.

Figure 1:
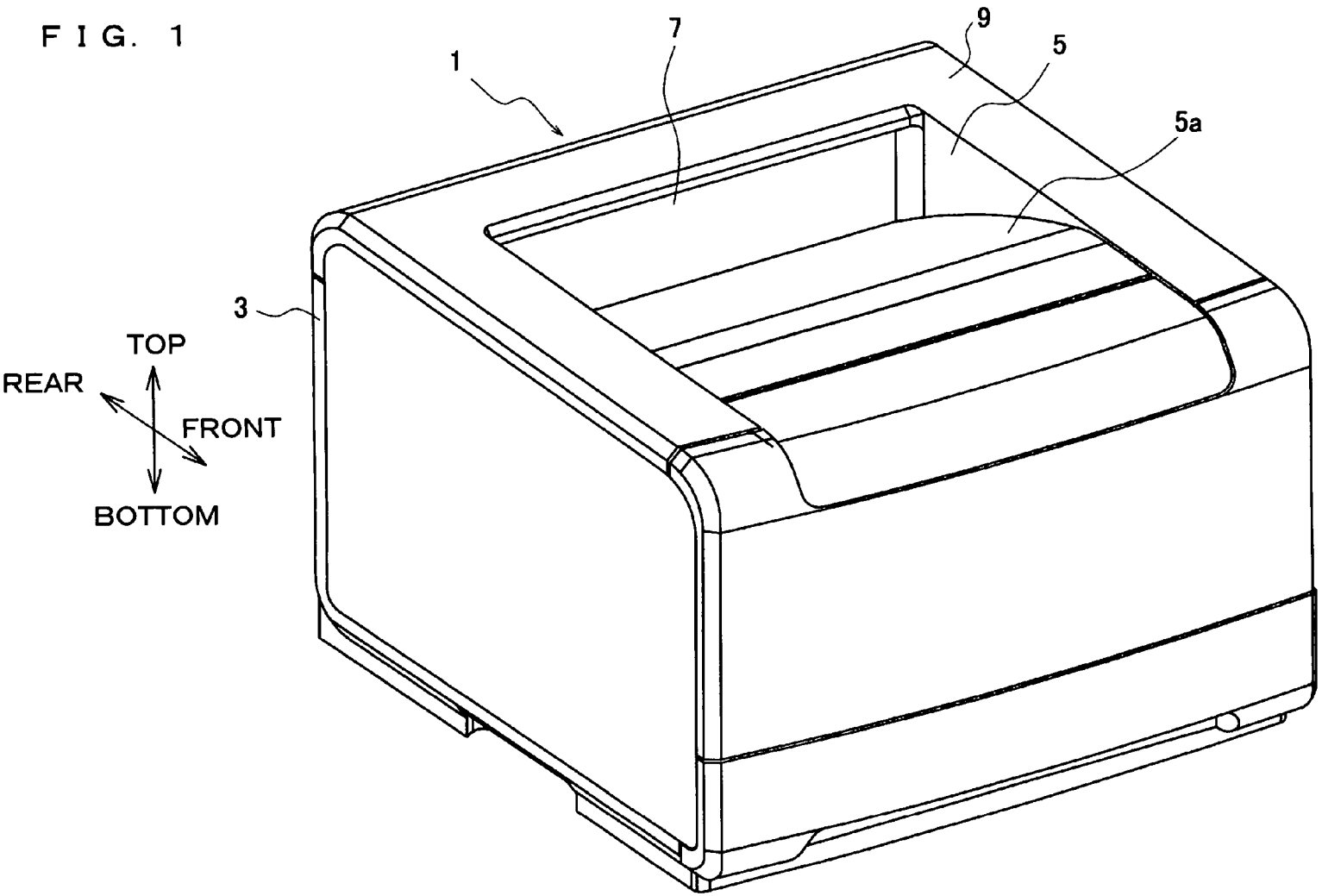
FIG. 1 is a perspective view showing an outer appearance of a laser printer 1 according to illustrative aspects of the invention.

As shown in FIG. 1, a case body 3 of a laser printer 1 is formed into approximately a box shape (cubic body), and a discharge tray 5 is provided on the upper side of the case body 3, on which a recording medium discharged from the case body 3 after completion of printing is placed. Note that sheets such as a normal paper and an OHP sheet are assumed in this embodiment as the recording medium.

The discharge tray 5 includes an inclined plane 5*a* that inclines so that a placing portion is lowered backward. In the vicinity of a rear end of the inclined plane 5*a*, a discharge section 7 is provided, from which the recording medium after completion of printing is discharged.

Figure 2:
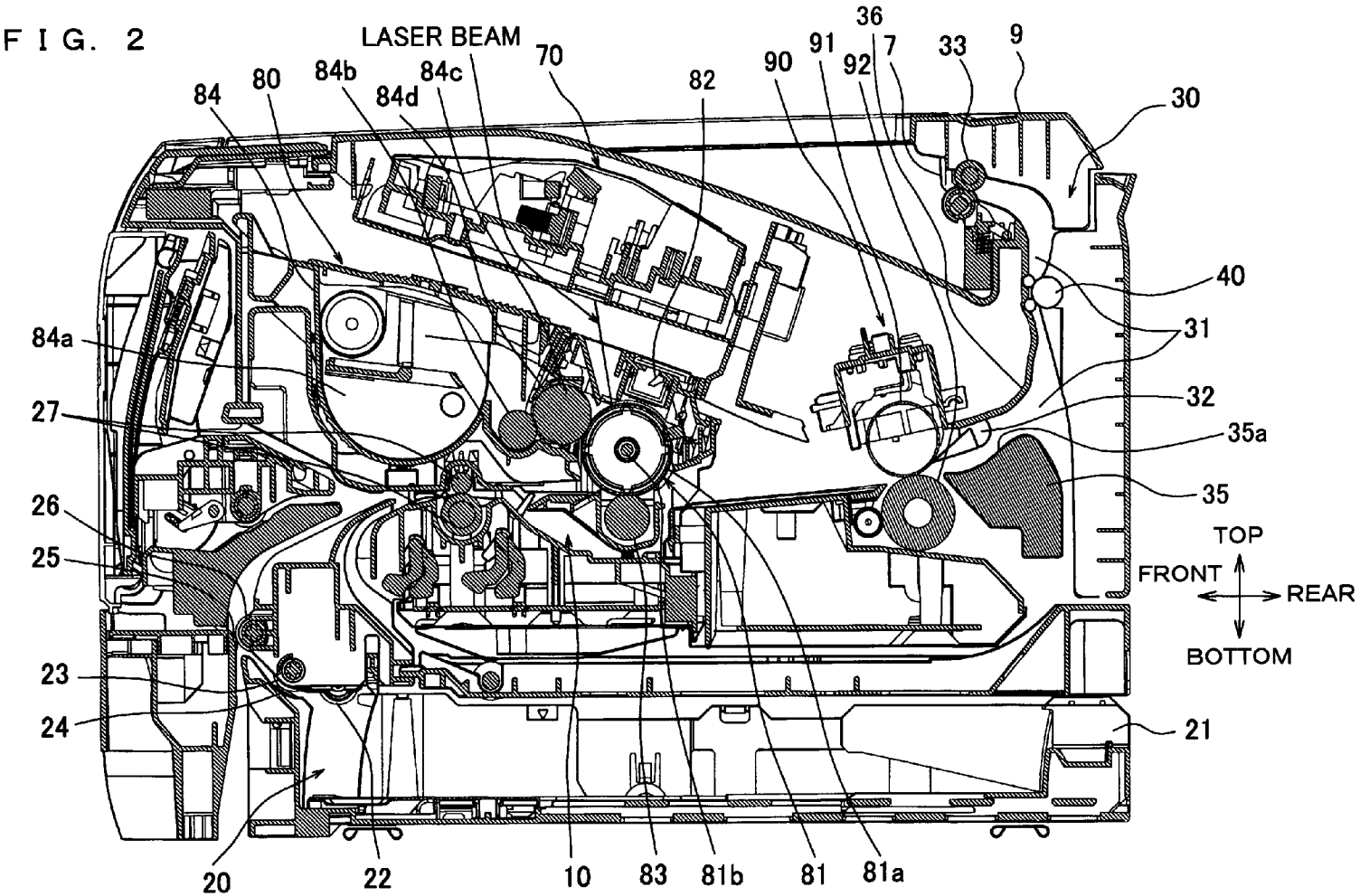
FIG. 2 is a lateral sectional view showing an essential part of the laser printer 1 according to illustrative aspects of the invention.

FIG. 2 is a lateral sectional view showing an essential part of the laser printer 1. An image forming unit 10 constitutes an image forming part for forming an image on the recording medium. A feeder unit 20 constitutes a part of a feeding part for feeding the recording medium to the image forming unit 10.

A discharge chute 30 includes a guide member (not shown) for guiding the recording medium to the discharge section 7 provided in an upper part of a fixing unit 90, by turning the feeding direction of the recording medium, on which the image is already formed by the image forming unit 10, by approximately 180° from the direction of the recording medium at the image forming unit 10, to make U-turn.

An intermediate feeding roller 40 for feeding the recording medium to the discharge section 7 is provided at a middle part of a feeding path 31 of the recording medium formed by the discharge chute 30 and a feeding path wall 36. A feeding direction turning part as a turning unit for turning the feeding direction of the recording medium discharged from the fixing unit 90 (heating roller 91) by approximately 90° is provided in the vicinity of an outlet of the fixing unit 90 on the upstream side of the feeding path 31. The feeding direction turning part has a baffling member 35 including a turning roller 32 and a baffling surface 35*a*. A discharge roller 33 for discharging the fed recording medium to a discharge tray 5 is provided at the end or the downstream of the feeding path 31.

The feeder unit 20 has a paper feeding tray 21 stored in a lowest part of the case body 3, a paper feeding roller 22 provided on a front end upper part of the paper feeding tray 21 to feed the recording medium to the image forming unit 10, and a separation roller 23 and a separation pad 24 for separating each sheet of the recording medium fed by the paper feeding roller 22. Then, the recording medium placed on the paper feeding tray 21 is fed to the image forming unit 10 disposed in an approximately center part in the case body 3, so as to make U-turn on the front side of the case body 3.

In addition, a paper powder removing roller 25 for removing paper powder, etc, adhered to an image forming surface (print surface) of the recording medium is disposed on an outer side face at the top of a part turning in a U-shape in the feeding path of the recording medium up to the image forming unit 10 from the paper feeding tray 21, and a facing roller 26 for pressing the recording medium to be fed against the paper powder removing roller 25 is disposed on an inner side face at the top thereof.

Further, resist rollers 27 composed of a pair of rollers for adjusting a feeding state of the recording medium by applying a feeding resistance to the recording medium is disposed at an inlet of the image forming unit 10 in the feeding path up to the image forming unit 10 from the paper feeding tray 21.

The image forming unit 10 comprises a scanner unit 70, a process cartridge 80, and the fixing unit 90.

The scanner unit 70 provided in an upper part of the case body 3 functions to form the electrostatic latent image on the surface of a photoreceptor drum 81 as will be described later, and is specifically composed of a laser light source, a polygon mirror, a fθ lens, and a reflective mirror and so forth.

The laser beam based on image data emitted from the laser light source is scanned by the polygon mirror, then passed through the fθ lens, with a light path turned back by the reflective mirror and the light path further bent downward by the reflective mirror, thereby being emitted on the surface of the photoreceptor drum 81, to form the electrostatic latent image thereon.

The process cartridge 80 is removably disposed in the case body 3 in a lower part of the scanner unit 70. The process cartridge 80 comprises the photoreceptor drum 81, a charging unit 82, a transfer roller 83, and a development cartridge 84.

The photoreceptor drum 81 serves as an image carrying part for carrying an image transferred to the recording medium. The photoreceptor drum 81 is constituted of a cylindrical drum body 81*a* formed by a positively charged photosensitive layer whose uppermost layer is composed of polycarbonate and the like, and a drum shaft 81*b* extending along a longitudinal direction of the drum body 81*a* to rotatably support the drum body 81*a* in an axial center of the drum body 81*a*.

The charging unit 82 serves as a charging part for charging the surface of the photoreceptor drum 81. The charging unit 82 is disposed in an obliquely rear upper part of the process cartridge 80 so as not to be in contact with the photoreceptor drum 81 at a predetermined interval therebetween, in a state of facing the photoreceptor drum 81. The charging unit 82 according to this embodiment is the charging unit of scorotron type, whereby the surface of the photoreceptor drum 81 is almost uniformly charged with positive electric charge by using corona discharge.

The transfer roller 83, oppositely arranged with the photoreceptor drum 81, rotates in conjunction with a rotation of the photoreceptor drum 81, and serves as a transfer part for transferring the toner stuck on the surface of the photoreceptor drum 81 to the print surface of the recording medium. When the recording medium passes in the vicinity of the photoreceptor drum 81, by allowing the electric charge opposite to that charged on the photoreceptor drum 81 (negative charge in this embodiment) to act on the recording medium from an opposite side of the print surface, the aforementioned transfer is practiced.

The development cartridge 84 comprises a toner storage chamber 84*a* in which the toner is stored, a toner feeding roller 84*b* for feeding the toner to the photoreceptor drum 81, and a development roller 84*c*.

The toner stored in the toner storage chamber 84*a* is fed to the development roller 84*c* side by the rotation of the toner feeding roller 84*b*, and the toner further fed to the development roller 84*c* side is carried on the surface of the development roller 84*c*, and after a thickness of the toner thus carried is adjusted to a predetermined fixed (uniform) thickness by a layer thickness regulating blade 84*d*, the toner thus adjusted is fed to the surface of the photoreceptor drum 81 which is exposed by the scanner unit 70.

The fixing unit 90 is disposed on the downstream side of the photoreceptor drum 81 in the feeding path of the recording medium, and allows the toner transferred to the recording medium to be heated, melted, and fixed thereto. Specifically, the fixing unit 90 is disposed on the side of the print surface of the recording medium, and comprises the heating roller 91 for feeding the recording medium while heating the toner. The fixing unit 90 further comprises a presser roller 92 disposed on the opposite side of the heating roller 91 through the recording medium, for pressing the recording medium against the heating roller 91.

The heating roller 91 is driven by a driving part such as a motor (not shown). Meanwhile, the presser roller 92 rotates by receiving a rotation power of the heating roller 91 through the recording medium which comes in contact with the heating roller 91.

In the image forming unit 10 having the aforementioned constitution, the image is formed on the recording medium as follows.

First, after the surface of the photoreceptor drum 81 is uniformly positively charged by the charging unit 82 in association with the photoreceptor drum 81 rotation, the photoreceptor drum 81 is exposed to high-speed scan of laser beams emitted from the scanner unit 70. Whereby, the electrostatic latent image corresponding to the image to be formed on the recording medium is formed on the surface of the photoreceptor drum 81.

Next, when positively charged toner carried on the development roller 84*c* comes in contact with the photoreceptor drum 81 opposite thereto, it is fed to the electrostatic latent image formed on the surface of the photoreceptor drum 81, namely, to an exposure part which is exposed to laser beams to drop a potential out of the uniformly positively charged surface of the photoreceptor drum 81. Thus, the electrostatic latent image of the photoreceptor drum 81 is made visible, because the toner image by inversion development is carried on the surface of the photoreceptor drum 81.

Thereafter, the toner image carried on the surface of the photoreceptor drum 81 is transferred to the recording medium by a transfer bias applied to the transfer roller 83. Then, the recording medium on which the toner image is transferred is fed to the fixing unit 90 and heated, then the toner transferred as the toner image is fixed on the recording medium, and an image formation is thus completed.

Figure 3:
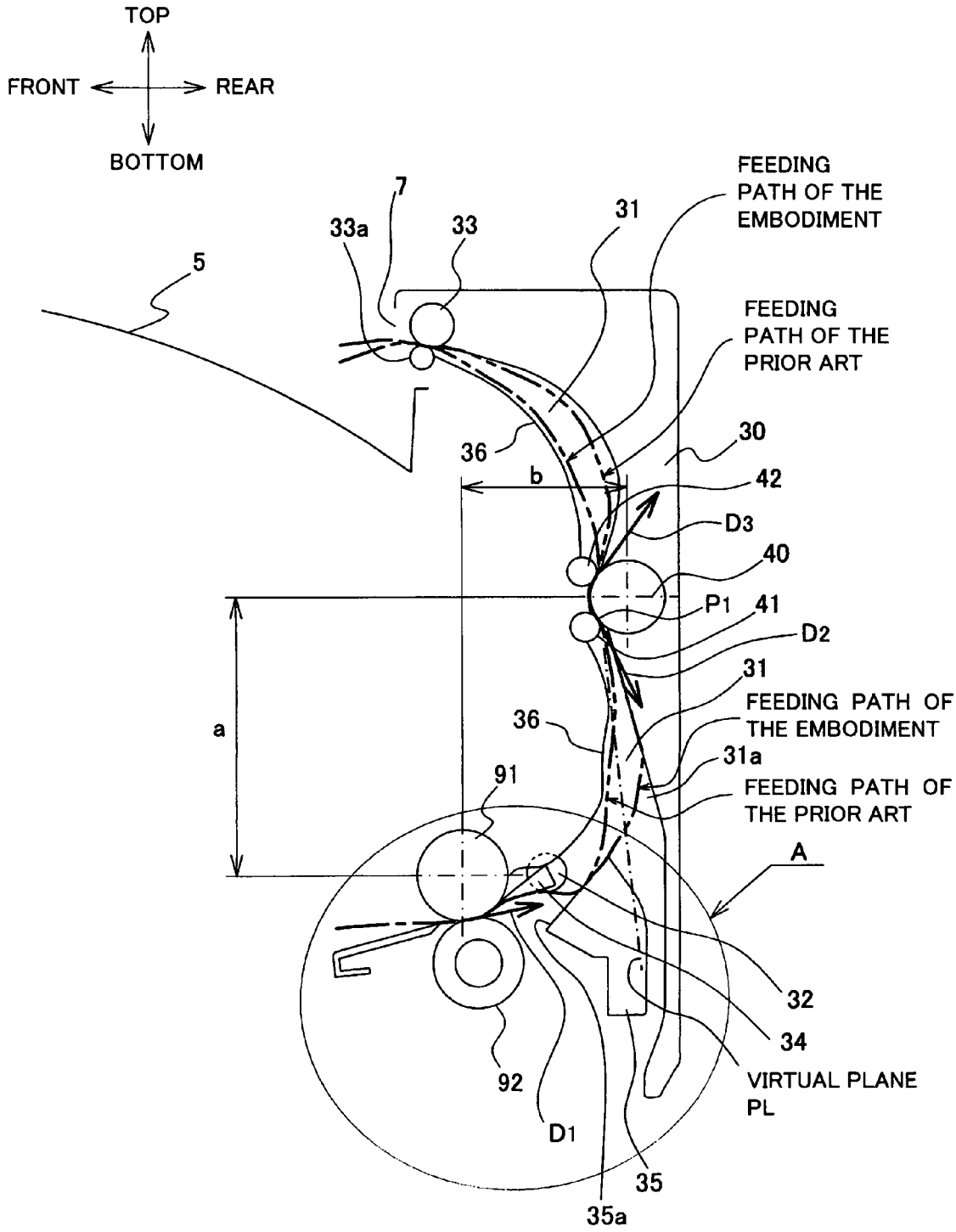
FIG. 3 is an expanded schematic diagram of a discharge chute 30 and a feeding path 31 in the laser printer according to illustrative aspects of the invention.
Figure 4:
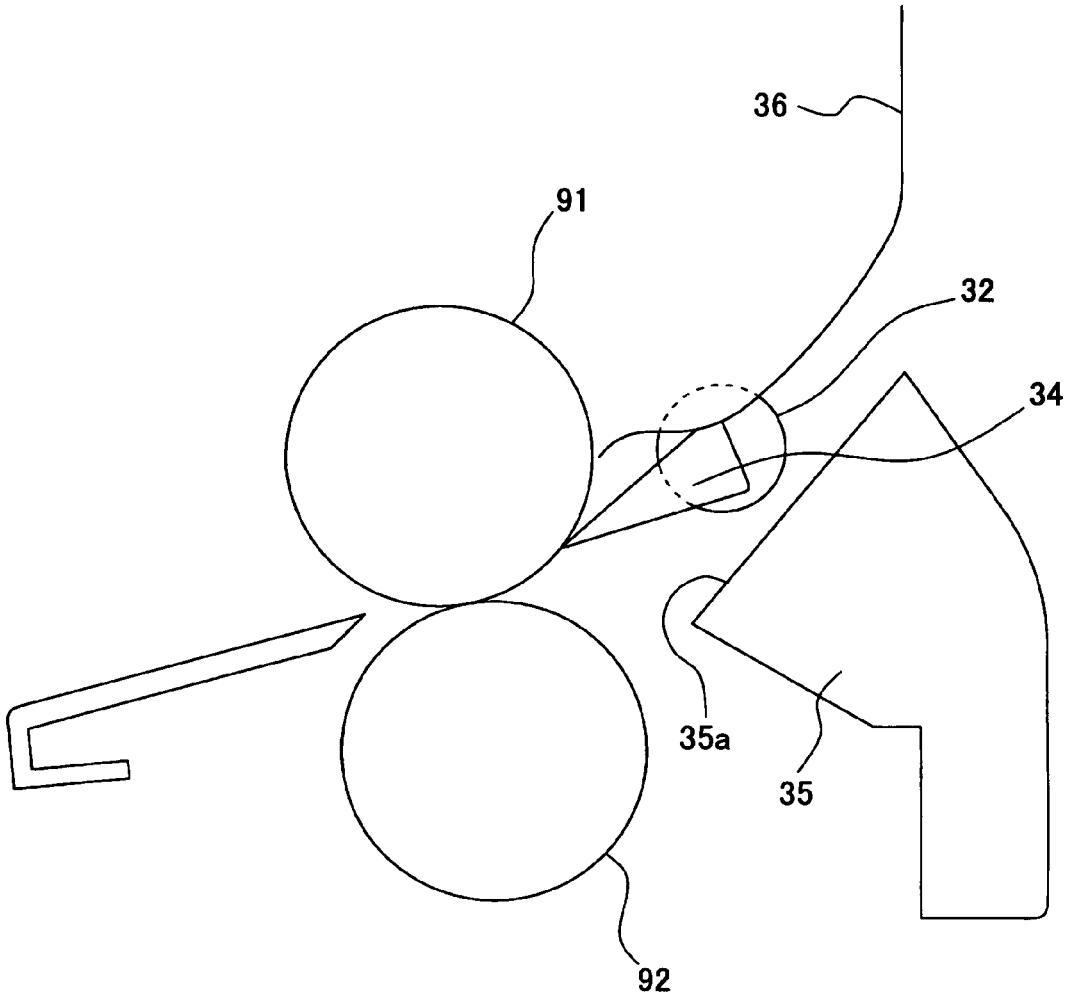
FIG. 4 is an expanded view of section A of FIG. 3.

FIG. 3 is an expanded schematic diagram of the discharge chute 30 and the feeding path 31, and FIG. 4 is an expanded view of A of FIG. 3.

As shown in FIG. 3, the discharge chute 30 and the feeding path wall 36 form the feeding path 31, and the feeding path 31 turns the recording medium discharged from the fixing unit 90 (heating roller 91) upward by approximately 90° and guides the recording medium to the discharge roller 33 where the recording medium is discharged in a direction approximately 180° from the feeding direction at the fixing unit 90. A peeling blade 34 for peeling from each other the recording medium heated by the heating roller 91 and the heating roller 91 is disposed on the downstream of the fixing unit 90 in the feeding direction.

The intermediate feeding roller 40 is provided in the middle part of the feeding path 31. The recording medium discharged from the fixing unit 90 is curved in a U-shape so as to be projected backward in the feeding path 31 between the fixing unit 90 and the intermediate feeding roller 40. The intermediate feeding roller 40 allows a pressing force to act on the recording medium, so that the recording medium is projected in a reverse direction (frontward). Such an action is based on the point that the intermediate feeding roller 40 is driven by the driving part such as a motor so as to rotate at a circumferential speed smaller than the circumferential speed of the heating roller 91. In this embodiment, the circumferential speed of the intermediate feeding roller 40 is set at approximately 0.97 times the circumferential speed of the heating roller 91.

Here, the "backward" refers to a feeding direction D1 of the recording medium when the recording medium is in contact with the heating roller 91. In this embodiment, the feeding direction D1 is in a front to back direction of the laser printer 1.

First and second nip rollers 41 and 42 are disposed on opposite sides of the intermediate feeding roller 40, so as to come in contact with the intermediate feeding roller 40. The first and second nip rollers 41 and 42 are pressed toward the intermediate feeding roller 40 by an elastic part (not shown) such as a spring and rotates in conjunction with the recording medium to be fed.

The first nip roller 41 is disposed on the upstream side in the feeding direction, so that a reverse direction D2 with respect to the feeding direction of the recording medium in the contact part between the intermediate feeding roller 40 and the first nip roller 41 is opposite the backward direction. The second nip roller 42 is disposed on the downstream side in the feeding direction is disposed, so that a feeding direction D3 of the recording medium in the contact part between the intermediate feeding roller 40 and the second nip roller 42 is in the backward direction.

In addition, an expanding space (a space) 31*a* expanding to the upstream side in the feeding direction from a contact part P1 between the intermediate feeding roller 40 and the recording medium is provided on the feeding path from the feeding direction turning part to the intermediate feeding roller 40. A width dimension (dimension of front to back direction) of the expanding space 31*a* becomes gradually larger toward the upstream of the feeding direction (downward) from the contact part P1.

Here, when a virtual plane PL (shown in FIG. 3 as a thin one-dot chain straight line) is defined, which ranges from the turning unit toward the contact part P1 and which is substantially vertical to the feeding direction D1, the expanding space 31*a* can be regarded as located on an opposite side of the fixing unit with respect to the virtual plane PL in the feeding direction D1 and being between the virtual plane PL and the discharge chute 30.

The discharge roller 33 is provided in the discharge section 7. The discharge roller 33 serves as a discharge part for discharging the recording medium fed through the feeding path 31 to the discharge tray 5. The discharge roller 33 is driven by a driving part, such as a motor, so as to rotate at the circumferential speed larger than the circumferential speed of the intermediate feeding roller 40. In this embodiment, the discharge roller 33 is driven so as to rotate at the same circumferential speed as the circumferential speed of the heating roller 91.

A nip roller 33*a* is disposed at a position facing the discharge roller 33, so as to sandwich the recording medium to be fed. The nip roller 33*a* is pressed toward the discharge roller 33 by an elastic part (not shown) such as a spring, and rotates in conjunction with the recording medium to be fed.

According to this embodiment, the circumferential speed of the intermediate feeding roller 40 is smaller than the circumferential speed of the heating roller 91, thus not allowing the tension to act on the recording medium present between the heating roller 91 and the intermediate transfer roller 40. Therefore, as shown by the thick one-dot chain line of FIG. 3, the recording medium is not firmly pressed against the turning roller 32, and a large bending stress is not generated in the recording medium. Therefore, the curvature of the recording medium in the turning roller 32 becomes smaller (curvature radius becomes larger).

Accordingly, a curl is prevented from generating in the recording medium, when the feeding direction of the recording medium discharged from the fixing unit 90 (heating roller 91) is turned by approximately 90° by the feeding direction turning part.

Note that in FIG. 3, the thick one-dot chain line shows the feeding direction of the recording medium in this embodiment, and the thick two-dot chain line shows the feeding path of the recording medium in a prior art.

At the same time, since the circumferential speed of the intermediate feeding roller 40 is smaller than the circumferential speed of the heating roller 91, a compression force in the feeding direction is applied to the recording medium present between the presser roller 91 and the intermediate feeding roller 40. Therefore, the recording medium present between the heating roller 91 and the intermediate feeding roller 40 is apt to be deformed in an S-shape. Accordingly, there is a possibility that the recording medium is buckled and deformed in an S-shape. Therefore, when the recording medium is buckled and deformed in an S-shape, it becomes impossible to smoothly feed the recording medium, thus resulting in the recording medium jamming in the feeding path 31.

However, the expanding space 31*a* allows the recording medium to be curved so as to become projected backward, without being buckled and deformed in an S-shape. Namely, since the recording medium can be smoothly fed, the recording medium is prevented from jamming.

According to this embodiment, the first nip roller 41 is disposed, so that the reverse direction D2 with respect to the feeding direction of the recording medium in the contact part between the intermediate feeding roller 40 and the first nip roller 41 is in a direction opposite to the backward direction. Therefore, the recording medium discharged from the heating roller 91 and curved so as to become projected backward can be smoothly guided between the intermediate feeding roller 40 and the first nip roller 41.

Accordingly, since the recording medium can be securely nipped between the intermediate feeding roller 40 and the first nip roller 41, it is possible to smoothly feed the recording medium.

According to this embodiment, the intermediate feeding roller 40 allows the recording medium to be curved in the reverse direction to a curve of the recording medium discharged from the fixing unit. Namely, the intermediate feeding roller 40 has a so-called curl removing function, and allows the curl removing function to act on the recording medium.

Incidentally, when the recording medium is curved in the reverse direction to the direction of the curve of a generated curl, the generated curl can be removed. However, it is preferable to remove the generated curl with the tension acted on the recording medium.

According to this embodiment, the circumferential speed of the discharge roller 33 is larger than the circumferential speed of the intermediate feeding roller 40. Therefore, the tension is applied to the recording medium present between the intermediate feeding roller 40 having the curl removing function and the discharge roller 33.

Therefore, the curl removing function can be effectively acted on the recording medium.

OTHER EMBODIMENT

In the aforementioned embodiment, the feeding direction turning part is constituted of a rotating roller, but the present invention is not limited thereto. Alternately, the feeding direction turning part may be constituted by a guide surface having a sliding face with a curved surface shape.

In addition, in the aforementioned embodiment, the intermediate feeding roller 40 has the curl removing function, but the present invention is not limited thereto. Alternately, the discharge roller 33 may be similar to the transfer roller 40 and have the curl removing function by having the discharge roller 33 softer than the nip roller 33*a*.

Also, in the aforementioned embodiment, the expanding space 31*a* is provided. However, the present invention is not limited thereto, and the expanding space 31*a* may be eliminated.

Further, the present invention is effective in a miniaturization of the front and back directional dimension of the image forming apparatus, and particularly is effective when applied to the image forming apparatus in which a ratio (b/a) of distance b (see FIG. 3) to distance a (see FIG. 3) becomes 0.1 to 1, the distance b being the distance between rotation centers of both rollers 91 and 40 when the heating roller 91 and the intermediate feeding roller 40 are projected onto a horizontal plane, and distance a being the distance between rotation centers of both rollers 91 and 40 when the heating roller 91 and the intermediate feeding roller 40 are projected onto a vertical plane.

Further, in the aforementioned embodiment, the circumferential speed of the turning roller 32 is equal to the circumferential speed of the discharge roller 33, but the present invention is not limited thereto.

As this description may be embodied in several forms without departing from the spirit of essential characteristics thereof, the present embodiments are therefore illustrative and not restrictive, since the scope is defined by the appended claims rather than by description preceding them, and all changes that fall within metes and bounds of the claims, or equivalence of such metes and bounds thereof are therefore intended to be embraced by the claims.

What is claimed is:

1. An image forming apparatus based on electrophotography, comprising:

a heating roller for providing feeding power to a recording medium while heating toner is transferred to said recording medium;

a turning unit for turning said recording medium fed from said heating roller, by approximately 90° with respect to a feeding direction of said recording medium; and a first discharge roller, disposed on a downstream side of said turning unit in said feeding direction immediately after said heating roller, for discharging said recording medium fed from said heating roller to a discharge section, wherein a circumferential speed of said first discharge roller is smaller than a circumferential speed of said heating roller.

2. The image forming apparatus according to claim 1, wherein space for preventing a curl of said recording medium is provided in a feeding path on which said recording medium is fed from said turning unit to said discharge section through said first discharge roller, wherein a width dimension of said space that is substantially parallel to a direction from said heating roller to said turning unit becomes gradually larger toward said turning unit from said first discharge roller.

3. The image forming apparatus according to claim 2, wherein said first discharge roller is configured to curve said recording medium in a reverse direction from a curve of said recording medium when said recording medium is discharged from said heating roller.

4. The image forming apparatus according to claim 1, wherein a space is provided between a feeding path wall extending from said heating roller to said first discharge roller, and a discharge chute for guiding said recording medium from said heating roller to said discharge section, wherein a width dimension of said space that is substantially parallel to a direction from said heating roller to said turning unit becomes gradually larger toward said turning unit from said first discharge roller.

5. The image forming apparatus according to claim 4, wherein a virtual plane is defined, which extends from said turning unit to a portion of a nip roller, which contacts said first discharge roller and which is substantially vertical to said feeding direction of said recording medium from said heating roller, and said space is located on an opposite side of said heating roller with respect to said virtual plane in said feeding direction of said recording medium from said heating roller, and provided between said virtual plane and said discharge chute.

6. The image forming apparatus according to claim 1, further comprising:

a pair of nip rollers oppositely disposed so as to be in contact with said first discharge roller, wherein one of said pair of nip rollers is located between said first discharge roller and said turning unit.

7. The image forming apparatus according to claim 6, wherein the feeding direction of the recording medium along a feeding path in a downstream direction reverses between the pair of nip rollers.

8. The image forming apparatus according to claim 1, further comprising:

a second discharge roller for discharging said recording medium to said discharge section, the second discharge roller being provided between said first discharge roller and said discharge section, wherein a circumferential speed of said second discharge roller is larger than the circumferential speed of said first discharge roller.

9. The image forming apparatus according to claim 8, wherein said first discharge roller is configured to curve said recording medium in a reverse direction from a curve of said recording medium when said recording medium is discharged from said heating roller, wherein space for preventing a curl of said recording medium is provided in a feeding path on which said recording medium is fed from said turning unit to said discharge section through said first discharge roller.

10. The image forming apparatus according to claim 8, wherein said second discharge roller is configured to curve said recording medium in a reverse direction from a curve of said recording medium when said recording medium is discharged from said heating roller, wherein a width dimension of a discharge path between said first discharge roller and said second discharge roller is larger at a position between said first discharge roller and said second discharge roller than a width dimension of the feeding path at said first discharge roller and said second discharge roller.

11. The image forming apparatus according to claim 1, further comprising:

means for removing a curl of said recording medium in a feeding path from said turning unit to said discharge section through said first discharge roller.

12. An image forming apparatus based on electrophotography, comprising:

a fixing unit for fixing toner transferred to a recording medium, the fixing unit having a heating roller for heating toner;

feeding direction turning means for turning said recording medium fed from said fixing unit, by approximately 90° with respect to a feeding direction of said recording medium; and a first discharge roller for discharging said recording medium, which is turned by said feeding direction turning means, to a discharge section, wherein a circumferential speed of said first discharge roller is smaller than a circumferential speed of said heating roller.

* * * * *